United States Patent [19]

Schleifstein

[11] 4,186,466

[45] * Feb. 5, 1980

[54] METHOD FOR MAKING FLAME RETARDANT-WATER REPELLENT COIL ZIPPER

[75] Inventor: Robert Schleifstein, Freehold Township, Monmouth County, N.J.

[73] Assignee: Coats & Clark, Inc., Stamford, Conn.

[ * ] Notice: The portion of the term of this patent subsequent to Sep. 5, 1995, has been disclaimed.

[21] Appl. No.: 886,632

[22] Filed: Mar. 15, 1978

Related U.S. Application Data

[63] Continuation-in-part of Ser. No. 820,564, Aug. 1, 1977, Pat. No. 4,111,647.

[51] Int. Cl.[2] ..... C09K 3/28; A44B 19/00

[52] U.S. Cl. ..... 24/205.13 C; 24/205 R; 427/390 D; 427/390 E; 427/430 R; 427/428; 427/354; 427/381; 428/921

[58] Field of Search ..... 24/205.13 C, 205 R; 427/381, 390 D, 390 E, 354, 430 R, 428; 428/920, 921

[56] References Cited

U.S. PATENT DOCUMENTS

| | | | |
|---|---|---|---|
| 3,540,924 | 11/1970 | Rozek et al. | 427/390 E |
| 3,914,827 | 10/1975 | Brown et al. | 24/205.13 C |
| 3,984,600 | 10/1976 | Kawase et al. | 24/205 R |
| 4,054,695 | 10/1977 | Johnson | 427/390 E |

*Primary Examiner*—John D. Smith

*Attorney, Agent, or Firm*—Burgess, Ryan and Wayne

[57] ABSTRACT

A method for making a flame retardant-water repellent coil zipper is disclosed. The method involves applying 1-20% (owg) of a flame retardant material and 1-10% (owg) of a water repellent material to the zipper coil followed by drying and curing for about 3 to about 7 minutes at about 150° to about 225° C., or drying for about 2 to about 4 minutes at about 120° to about 150° C. and then curing for about 1 to about 5 minutes at about 150° to about 220° C. The flame retardant material and the water repellent material could be applied together or sequentially.

7 Claims, No Drawings

METHOD FOR MAKING FLAME RETARDANT-WATER REPELLENT COIL ZIPPER

CROSS-REFERENCE TO RELATED APPLICATION

This is a continuation-in-part of my copending application, Ser. No. 820,564, filed Aug. 1, 1977 now U.S. Pat. No. 4,111,647, dated Sept. 5, 1978.

BACKGROUND OF THE INVENTION

This invention relates generally to the manufacture of coil zippers and, specifically, this invention relates to a method of making coil zippers flame retardant and water repellent.

Over the last few years, various government agencies have been requiring the treatment of certain fabric articles to make them flame retardant. These requirements have been especially stringent in manufacturing clothing and, in particular, clothing for children. Yet, the requirement for making certain articles flame retardant is not limited only to clothing but covers a wide variety of fabric materials. Furthermore, there are many fabric articles which are treated by their manufacturers to be flame retardant notwithstanding the fact that there might not be any particular requirement to do so. Thus, there are a wide variety of articles which are made flame retardant, either because of laws or regulations, or completely voluntarily. These articles include not only clothing, and in particular, children's clothing, but they also include camping equipment such as tents and sleeping bags, draperies and curtains, and the like. The treatment of the fabric used to make these articles is usually fairly straight-forward.

But, many of these articles are produced from fabric and then have attached to them a variety of fasteners such as zippers.

Most people think of a zipper as being a metal fastener, but they are unaware that the latest development in zippers is the so-called coil zipper which is completely fabricated of a plastic material, usually a polyester. Furthermore, the zipper is combined with a fabric tape which, in turn, is attached to the garment or other article by stitching or some other suitable means. The fabric of the tape is also usually a polyester.

The reasons for making a fabric item water repellent and self-evident. Raincoats, jackets, tents, sleeping bags, etc. must be water-repellent as well as flame-retardant.

It is not complete satisfactory to manufacture a garment or tent, for instance, using a flame retardant and water repellent fabric only to include a zipper which may not be flame retardant and water repellent or which may be mounted on a fabric tape which is not flame retardant and water repellent. In fact, a panel in which an untreated coil zipper is sewn into a flame retardant canvas, may not be able to meet the flammability requirements of MVSS-302. This occurs because of the thermoplastic nature of a coil zipper and the inherent flammability in its construction.

Yet, the normal methods for impregnating a fabric with a flame retardant material and a water repellent material are not completely satisfactory for rendering a coil zipper flame retardant and water repellent. Furthermore, the hygroscopicity of most flame retardants and flammability of common water repellents complicates the matter of obtaining such a dual treatment. It is for these reasons that flame retardant and water repellent coil zippers have heretofore not been made.

SUMMARY OF THE INVENTION

It is, therefore, a primary object of the present invention to provide a method for making a coil zipper flame retardant and water repellent.

It is another object of the present invention to provide a method for making a zipper flame retardant and water repellent using currently available equipment.

It is still another object of the present invention to provide a method for easily and efficiently imparting flame retardancy and water repellency to a coil zipper.

It is a further primary object of the present invention to provide a flame retardant, water repellent coil zipper.

Consistent with the foregoing objects, the present invention is a method for making coil zippers, particularly 100% polyester coil zippers, flame retardant and water repellent by impregnating the coil zipper with a suitable flame retardant material and a suitable water repellent material in a water bath and then drying and curing the impregnated coil zipper. More specifically, the water solution or dispersion of the flame retardant material and water repellent material are applied to the zipper chain by saturation, spraying, or coating, with the preferred mode of application being a pad bath in a manner which is conventional in the dyeing arts. A pad-type dyer generally passes the material to be dyed over a guide roller into the dye vat and around another guide roller in the vat. The material emerges from the dye bath and passes between a pair of squeeze rollers. Thus, in the instant process, the coil zipper chain would pass through the impregnating bath and then between squeeze rollers. In an alternate embodiment, the zipper chain which is already impregnated with a flame retardant material by an exhaust bath process according to the invention of the aforementioned copending application is treated with the flame retardant material in a pad bath. In another alternate embodiment, the flame retardant material and water repellent material can be applied separately using a pad process.

Generally, any water repellent material which can be applied from an aqueous solution or dispersion can be used. The preferred water repellents are FC-232® from 3M Corporation or Zepel K® from Dupont. These water repellents are aqueous emulsion polymers or perfluoro compounds or polymers which perfluoro side chains. Other water repellents of the wax, resinous, or silicone type may be used, although their effectiveness is significantly reduced compared to the preferred water repellents. The level of treatment with the water repellent is from about 1 to about 10% (owg).

In general, any flame retardant material which is water-soluble or water-dispersable may be used. Typical of such fire retardant materials which are merely exemplary and should not be limiting are tris (2,3-dibromopropyl) phosphate, tris (2,3-dichloropropyl) phosphate, tris (beta chloropropyl) phosphate, and tris (beta chloroethyl) phosphate. The preferred fire retardants, however, are the non-halogen containing materials such as Antiblaze 19® from Mobil Chemical. This is a phosphorous based fire retardant whose chemical structure is:

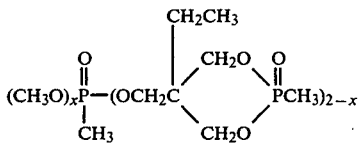

x = 0 or 1

The level of treatment of the flame retardant is from about 1 to about 20% (owg).

The preferred levels of treatment are from about 1 to about 5% (owg) for the water repellent and from about 3 to about 10% (owg) for the fire retardant. The terminology "owg" is commonly used in the art as meaning "on the weight of the goods", that is, the percent of dry material by weight based on the weight of the goods to be treated. Furthermore, this percentage is the amount of material actually delivered on the goods, the initial bath containing somewhat more, but in an amount easily determined by one skilled in the art.

As for processing conditions, these will vary according to the chemicals used, the amount of liquid left on the chain after treatment, and the type of dryer used. If drying and curing are performed in one step, treatment should be from about 3 to about 7 minutes at from about 150° C. to about 225° C. It is preferred that one-step drying and curing be conducted for about 5 minutes at about 220° C. If drying and curing are accomplished in two stages, drying should be for about 2 to about 4 minutes at from about 120° to about 150° C. with curing being from about 1 to about 5 minutes at from about 150° to about 220° C. The preferred conditions for the two-step drying and curing are about 2 to about 3 minutes at about 140° C. for drying and from about 1 to about 2 minutes at about 200° C. for curing.

While these temperatures are preferred, satisfactory results can be achieved by the use of lower temperatures for longer times which can easily be determined by one skilled in the art. A higher temperature would generally be unfeasible since the melting temperature of the polyester would be approached. Thus, the upper limit of drying and curing temperatures is the melting point of the polyester used for the zipper. Furthermore, the drying and curing can be accomplished at still lower temperatures if resistance of the fire retardant to water extraction or leaching is not required.

DESCRIPTION OF THE PREFERRED EMBODIMENT

In the preferred embodiment, a 100% polyester zipper chain is treated in a pad treatment machine with a water dispersion of FC-232 water repellent and Antiblaze 19 fire retardant in an amount of 1.8% and 6.0%, respectively, and at room temperature or approximately 30° C. The chain was dried and cured in one step at a temperature of 220° C. for 5 minutes.

Using the same procedure, another sample was treated at a fire retardant level of 3%.

Using the same procedure, another sample was treated using Zepel K water repellent at a level of 3.0% and Antiblaze 19 fire retardant at a level of 6.0%.

Still another sample was treated in two steps using an exhaust procedure according to the aforementioned copending application to impregnate the chain with tris dichloroisopopropyl phosphate at a level of 12.0% followed by a pad procedure for applying FC-232 water repellent at a level of 1.8%. Drying and curing was conducted the same as the previous examples.

Fire retardancy and water repellency were tested according to standard tests and the results are set forth in the following tables:

TABLE I

| | |
|---|---|
| Substrate | 100% polyester zipper chain simultaneously treated for fire retardancy and water repellency |
| Fire Retardant | Antiblaze 19 - phosphorous-based compound |
| Test | Motor Vehicle Safety Standard #302 - Horizontal Flammability Test - 15 second ignition |

| Sample | Exposed To Water Leaching | Burn Distance "D" (in.) | After Flame Time "T" (sec.) | Burn Rate (in./min.) $B = \frac{60 \times D}{T}$ | Test Criterion |
|---|---|---|---|---|---|
| Control | No | 11.0 | 118 | 5.6 | Fail |
| 3% FR | No | 8.75 | 185.5 | 2.8 | Pass |
| 3% FR | Yes | 8.5 | 163.4 | 3.1 | Pass |
| 6% FR | No | 0.25* | 35.0 | 0.4 | Pass |
| 6% FR | Yes | 7.6 | 247.1 | 1.9 | Pass |

Burn Rate must be <4.0 inches/minute

*When "D" <2.0 inches, sample automatically passes test

TABLE II

EFFECTS OF WATER REPELLENT ON 100% POLYESTER ZIPPER CHAIN

| Static Absorption A.A.T.C.C.-21-1972 % Moisture Pick-Up | Sample | Wicking-Vertical Rise VT-00285a Army GL Test Criterion 2 Hour Minimum |
|---|---|---|
| 27.4 | Untreated (control) | Fail |
| 2.1 | 1.8% FC-232 Water Repellent plus 6.0% Antiblaze 19 Fire Retardant-Simultaneously Treated | Pass |
| 7.5 | 3.0% Zepel K Water Repellent plus 6.0% Zntiblaze 19 Fire Retardant-Simultaneously Treated | Pass |
| 5.0 | 1.8% FC-232 Water Repellent on top of prior treated (via package-exhaust procedure) FR zipper-12.0% tris dichloroisopropyl | Pass |

TABLE II-continued

| EFFECTS OF WATER REPELLENT ON 100% POLYESTER ZIPPER CHAIN | | |
|---|---|---|
| Static Absorption A.A.T.C.C.-21-1972 % Moisture Pick-Up | Sample | Wicking-Vertical Rise VT-00285a Army GL Test Criterion 2 Hour Minimum |
| | phosphate | |

What is claimed is:

1. A method of imparting fire retardancy and water repellency to a polyester coil zipper comprising:

(A) applying by a pad process from about 1 to about 20% (owg) of a fire retardant and from about 1 to about 10% (owg) of a water repellent simultaneously in an aqueous solution or dispersion to said coil zipper; and (B) drying and curing the thus-treated zipper, said water repellent being a perfluoro-containing polymer and said fire retardant being:

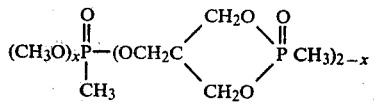

where x = 0 or 1.

2. A method as claimed in claim 1, wherein the amount of said water repellent is from about 2 to about 5% (owg) and the amount of said fire retardant is from about 3 to about 10% (owg).

3. A method as claimed in claim 1, comprising drying and curing said zipper in one step from about 3 to about 7 minutes at from about 150° C. to about 225° C.

4. A method as claimed in claim 3, wherein said drying and curing is for about 5 minutes at about 220° C.

5. A method as claimed in claim 1, comprising drying said zipper for from about 2 to about 4 minutes at from about 120° to about 150° C. and then curing for from about 1 to about 5 minutes at from about 150° to about 220° C.

6. A method as claimed in claim 5, comprising drying for about 2 to about 3 minutes at about 140° C. and curing for about 1 to about 2 minutes at about 200° C.

7. A product as made by the process of claim 1.

* * * * *

UNITED STATES PATENT OFFICE

CERTIFICATE OF CORRECTION

Patent No. 4,186,466 Dated February 5, 1980

Inventor(s) Robert Schleifstein

It is certified that error appears in the above-identified patent and that said Letters Patent are hereby corrected as shown below:

Column 1, line 43: "the zipper is" should be --the coil zipper is

Column 1, line 48: "and self-evident" should be --are self-evident

Column 2, line 51: "which" should be --with--.

Column 4, Table II, under the heading "Sample", the 6th line down: "Zntiblaze" should be --Antiblaze--.

Column 4, Table II, under the heading "Sample", last line of Table "tris dichloroisopropyl" should be --tris dichloroisopropyl phosphate--.

Column 5, Table II-continued, last line of Table: Cancel "phosphate".

Signed and Sealed this

Twenty-fourth Day of June 1980

[SEAL]

Attest:

SIDNEY A. DIAMOND

Attesting Officer

Commissioner of Patents and Tradem